US009796508B1

(12) United States Patent
Rutherford

(10) Patent No.: US 9,796,508 B1
(45) Date of Patent: Oct. 24, 2017

(54) CAULK STORAGE SYSTEM

(71) Applicant: Paul Rutherford, Lawton, OK (US)

(72) Inventor: Paul Rutherford, Lawton, OK (US)

( * ) Notice: Subject to any disclaimer, the term of this patent is extended or adjusted under 35 U.S.C. 154(b) by 0 days.

(21) Appl. No.: 15/205,394

(22) Filed: Jul. 8, 2016

(51) Int. Cl.
*B65D 25/34* (2006.01)
*B05C 17/005* (2006.01)
*B65D 25/40* (2006.01)

(52) U.S. Cl.
CPC ..... *B65D 25/34* (2013.01); *B05C 17/00503* (2013.01); *B05C 17/00596* (2013.01); *B65D 25/40* (2013.01)

(58) Field of Classification Search
CPC .. B65D 25/34; B65D 25/40; B05C 17/00503; B05C 17/00596
USPC ..... 206/277, 384, 385, 813; 220/4.21, 4.24
See application file for complete search history.

(56) References Cited

U.S. PATENT DOCUMENTS 3,275,179 A * 9/1966 Lux ..... B29C 44/1228 156/73.5
3,930,599 A 1/1976 Brothers et al.
4,210,253 A * 7/1980 Rosler ..... B65D 21/086 220/8
4,326,648 A * 4/1982 Kieber ..... A47K 5/122 222/162
D360,828 S 8/1995 Ball
5,680,946 A * 10/1997 Cochran ..... B65D 41/18 215/317
5,788,194 A 8/1998 Van Den Berg
D420,216 S 2/2000 Birbeck, III
6,302,575 B1 * 10/2001 Anderson ..... B01F 11/0008 366/209
6,832,797 B1 12/2004 Gassel et al.
6,895,976 B2 * 5/2005 Hetzler ..... A46B 15/0091 132/308
7,032,790 B2 4/2006 Williamson, IV et al.
7,410,080 B2 * 8/2008 Good ..... A45F 5/02 224/251
9,090,385 B2 * 7/2015 Blagojevic ..... B65D 53/00
D779,056 S * 2/2017 Brannon ..... D24/127
2001/0048198 A1 12/2001 Dulin
2005/0236441 A1 10/2005 Martin
2007/0181573 A1 * 8/2007 Dawson ..... A45C 11/00 220/4.21
2008/0283431 A1 * 11/2008 Joss ..... B25H 3/04 206/384
2009/0032424 A1 * 2/2009 McLaughlin ..... A45D 40/16 206/385
2011/0180437 A1 * 7/2011 Alt ..... B25H 3/02 206/372
2014/0231444 A1 8/2014 Di Molfetta

FOREIGN PATENT DOCUMENTS

WO WO2013013301 1/2013

* cited by examiner

*Primary Examiner* — Nicholas J Weiss

(57) ABSTRACT

A caulk storage system for storing an opened calk container includes a calk container that has a tube and a spout. The calk container may contain a fluid calk. A pair of cylinders is provided. The cylinders are matable to each other to define a closed tube. The calk container is positioned in each of the cylinders when the cylinders are mated together. Thus, the pair of cylinders inhibits the fluid calk from drying thereby facilitating the calk container to be stored when the calk container is opened.

5 Claims, 4 Drawing Sheets

CAULK STORAGE SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to storage devices and more particularly pertains to a new storage device for storing an opened calk container.

BRIEF SUMMARY OF THE INVENTION

An embodiment of the disclosure meets the needs presented above by generally comprising a calk container that has a tube and a spout. The calk container may contain a fluid calk. A pair of cylinders is provided. The cylinders are matable to each other to define a closed tube. The calk container is positioned in each of the cylinders when the cylinders are mated together. Thus, the pair of cylinders inhibits the fluid calk from drying thereby facilitating the calk container to be stored when the calk container is opened.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
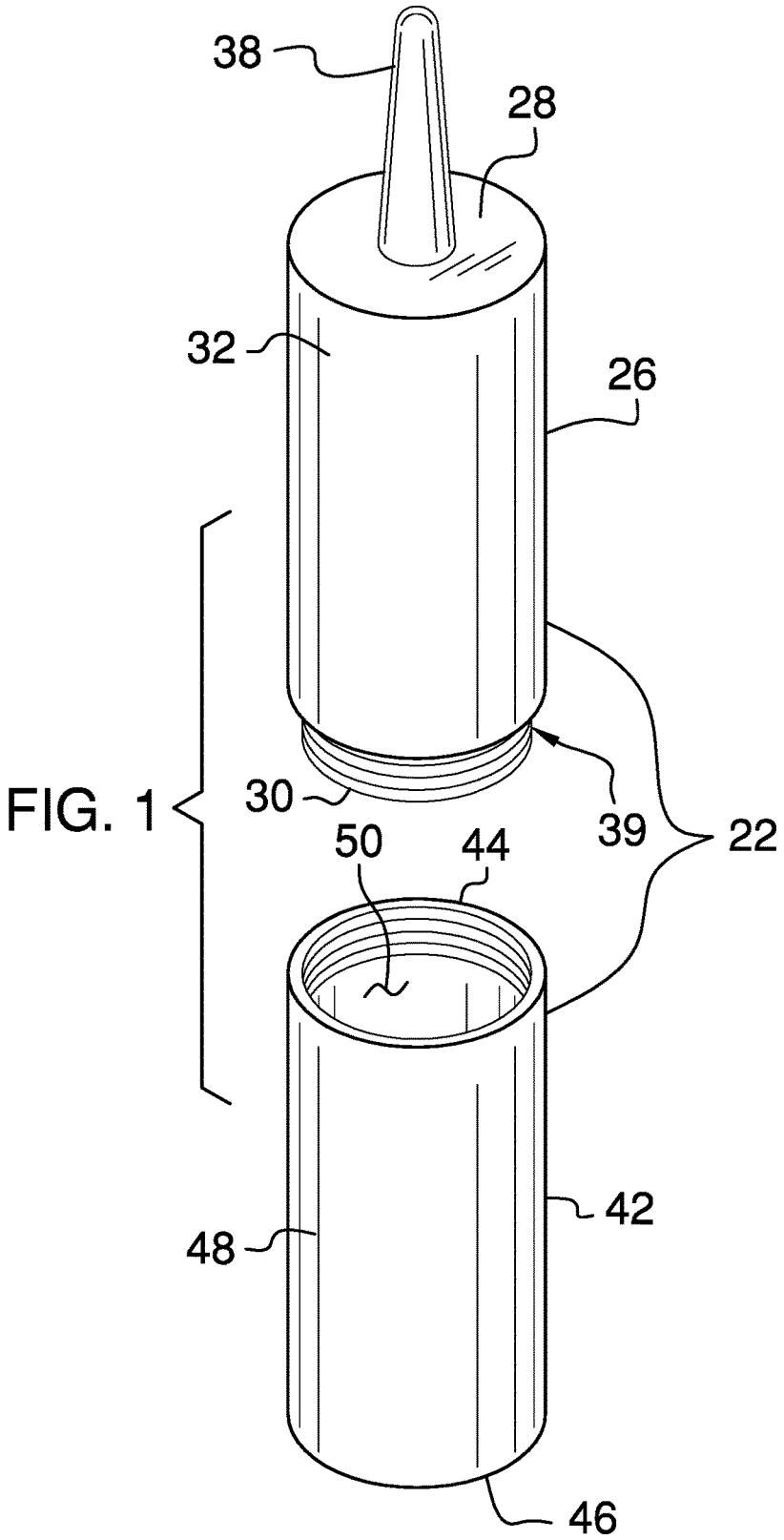
FIG. 1 is a perspective view of a caulk storage system according to an embodiment of the disclosure.
Figure 2:
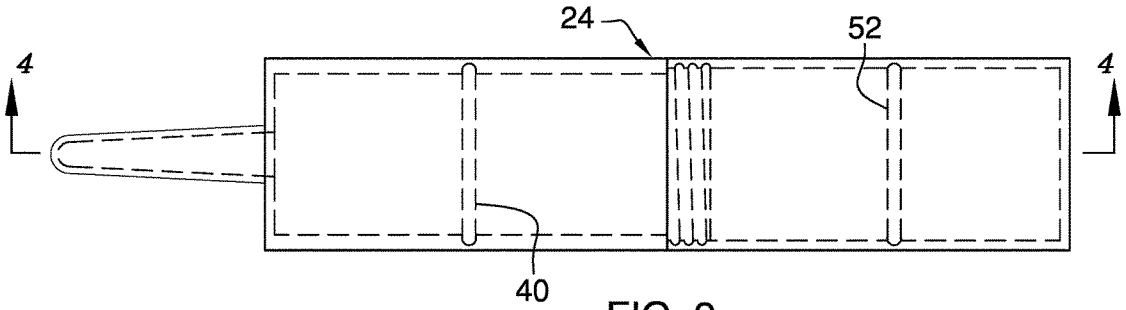
FIG. 2 is a right side view of an embodiment of the disclosure.
Figure 3:
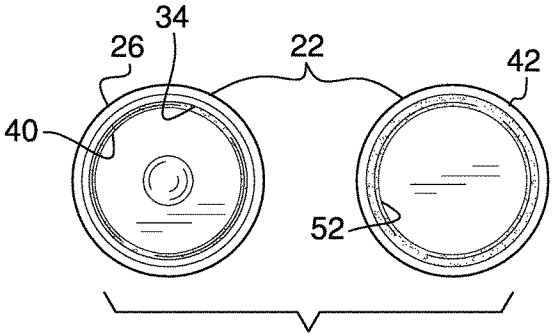
FIG. 3 is a back view of an embodiment of the disclosure.
Figure 4:
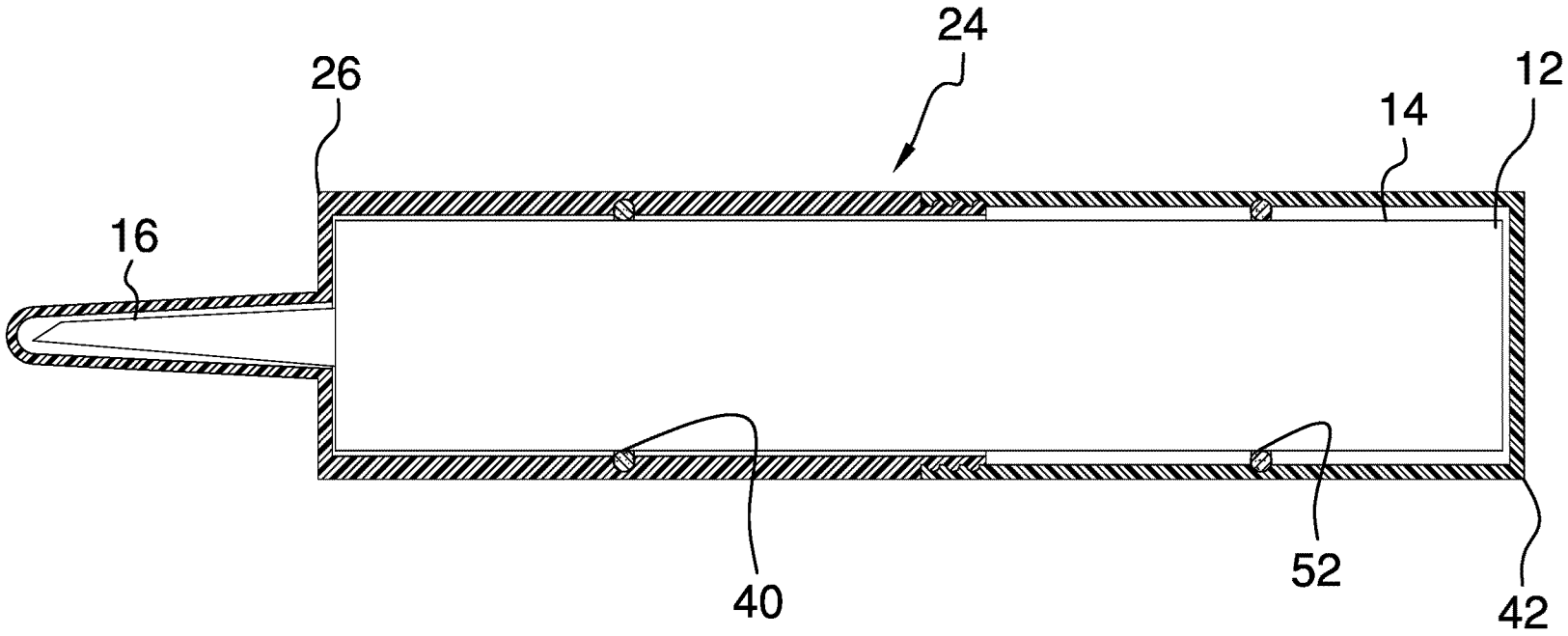
FIG. 4 is a cross sectional view taken along line 4-4 of FIG. 2 of an embodiment of the disclosure.
Figure 5:
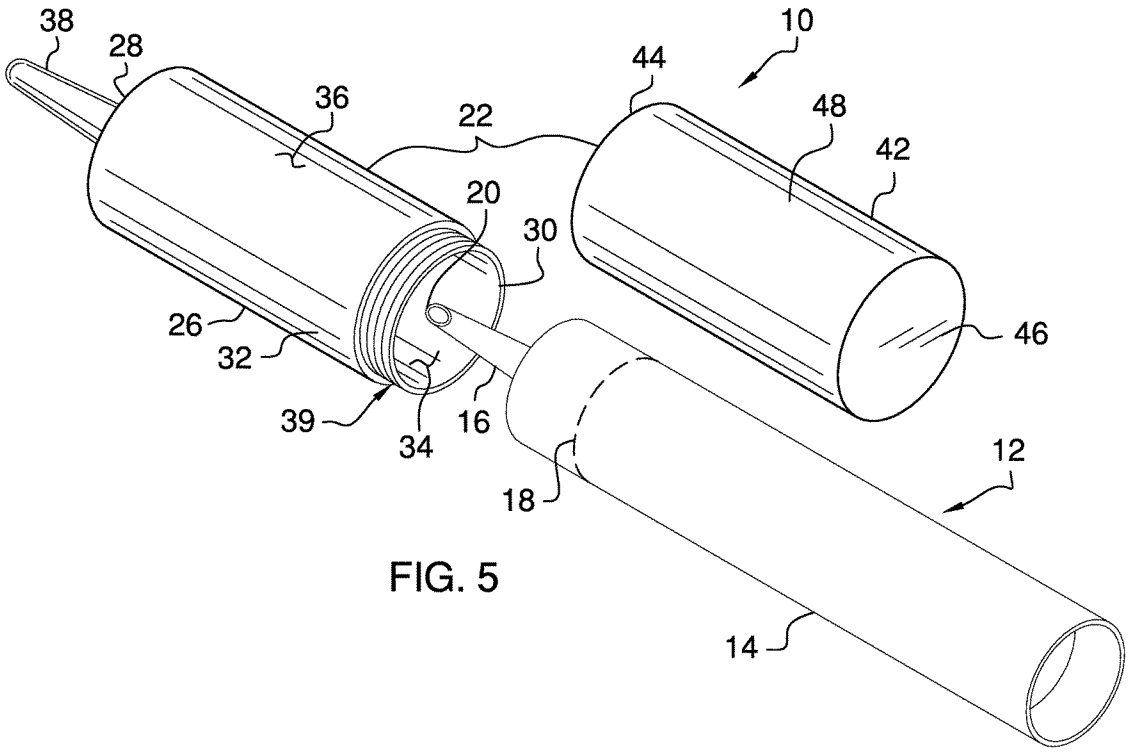
FIG. 5 is an exploded perspective view of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the caulk storage system 10 generally comprises a calk container 12 that has a tube 14 and a spout 16. The calk container 12 contains a fluid calk 18. The calk container 12 may be a calk tube of any conventional design. The spout 16 has a distal end 20 with respect to the tube 14. The distal end 20 is selectively cut off to open the calk container 12.

A pair of cylinders 22 is provided. The cylinders 22 are matable to each other to define a closed tube 24. The opened calk container 12 is positioned in each of the cylinders 22 when the cylinders 22 are mated together. Thus, the pair of cylinders 22 inhibits the fluid calk 18 from drying thereby facilitating the calk container 12 to be stored when the calk container 12 is opened.

The pair of cylinders 22 comprises a first cylinder 26 that has a first end 28, a second end 30 and an outer wall 32 extending therebetween. The outer wall 32 has an inner surface 34 and an outer surface 36. The second end 30 is open and the first cylinder 26 is substantially hollow. The first cylinder 26 may have an inside diameter that is greater than an outside diameter of the calk container 12.

A cone 38 is coupled to the first end 28 of the first cylinder 26 and the cone 38 is substantially hollow. The cone 38 is in fluid communication with an interior of the first cylinder 26. The calk container 12 is selectively positioned in the first cylinder 26. The spout 16 is positioned within the cone 38 when the calk container 12 is positioned in the first cylinder 26. The outer surface 36 of the first cylinder 26 is recessed adjacent to the second end 30 to define a recessed portion 39 of the outer surface 36. The recessed portion 39 is threaded.

A first gasket 40 is coupled to the inner surface 34 of the first cylinder 26. The first gasket 40 is continuous such that the first gasket 40 forms a closed loop. The first gasket 40 frictionally engages the tube 14 when the calk container 12 is positioned in the first cylinder 26. The first gasket 40 is comprised of a resiliently compressible material such as silicone or the like. Thus, the first gasket 40 inhibits the calk container 12 from sliding in the first cylinder 26.

The pair of cylinders 22 includes a second cylinder 42 that has a primary end 44, a secondary end 46 an exterior wall 48 extending therebetween. The primary end 44 is open and the second cylinder 42 is substantially hollow. The exterior wall 48 has an inside surface 50. The second cylinder 42 has an inside diameter that is greater than an outside diameter of the calk container 12.

The primary end 44 insertably receives the recessed portion 39 of the first cylinder 26. The inside surface 50 threadably engages the recessed portion 39 such that the second cylinder 42 is mated to the first cylinder 26. The second cylinder 42 forms a fluid impermeable seal with the first cylinder 26. Thus, the fluid calk 18 is inhibited from drying when the calk container 12 is positioned in the cylinders 22.

A second gasket 52 is provided. The second gasket 52 is coupled to the inside surface 50 of the second cylinder 42. The second gasket 52 is continuous such that the second gasket 52 forms a closed loop. The second gasket 52 frictionally engages the tube 14 when the calk container 12 is positioned in the second cylinder 42. The second gasket 52 is comprised of a resiliently compressible material. The second gasket 52 inhibits the calk container 12 from sliding in the second cylinder 42.

In use, the calk container 12 is opened and manipulated in the convention of dispensing fluid calk 14. The calk container 12 is positioned in the first cylinder 26 to store the opened calk container 12. The second cylinder 42 is mated to the first cylinder 26. Thus, the opened calk container 12 is stored within the first 26 and second 42 cylinders. The fluid calk 14 in the opened calk container 12 is preserved for future use. The opened calk container 12 is discarded when the fluid calk 14 is depleted.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A caulk storage system comprising:

a caulk container having a tube and a spout, said caulk container being configured to contain a fluid caulk; and a pair of cylinders, said cylinders being matable to each other to define a closed tube, said caulk container being positioned in each of said cylinders when said cylinders are mated together wherein said pair of cylinders is configured to inhibit the fluid caulk from drying thereby facilitating the caulk container to be stored when said caulk container is opened;

wherein said pair of cylinders includes a first cylinder having a first end, a second end and an outer wall extending therebetween, said outer wall having an inner surface and an outer surface, said second end being open, said first cylinder being substantially hollow, said first cylinder having a cone being coupled to said first end, said cone being substantially hollow, an interior of said cone being in fluid communication with an interior of said first cylinder, said caulk container being selectively positioned in said first cylinder having said spout being positioned within said cone;

said first cylinder further comprising a first gasket being coupled to said inner surface of said first cylinder at a location generally midway between said first end and said second end of said first cylinder, said first gasket being continuous such that said first gasket forms a closed loop, said first gasket frictionally engaging said tube when said caulk container is positioned in said first cylinder.

2. The system according to claim 1, wherein said outer surface is recessed adjacent to said second end to define a recessed portion of said outer surface, said recessed portion being threaded.

3. The system according to claim 1, wherein: said pair of cylinders includes a second cylinder having a primary end, a secondary end an exterior wall extending therebetween, said primary end being open, said second cylinder being substantially hollow, said exterior wall having an inside surface, said primary end insertably receiving said recessed portion having said inside surface threadably engaging said recessed portion such that said second cylinder is mated to said first cylinder.

4. The system according to claim 3, further comprising a second gasket being coupled to said inside surface of said second cylinder, said second gasket being continuous such that said second gasket forms a closed loop, said second gasket frictionally engaging said tube when said caulk container is positioned in said second cylinder.

5. A caulk storage system comprising:

a caulk container having a tube and a spout, said caulk container being configured to contain a fluid caulk; and a pair of cylinders, said cylinders being matable to each other to define a closed tube, said caulk container being positioned in each of said cylinders when said cylinders are mated together wherein said pair of cylinders is configured to inhibit the fluid caulk from drying thereby facilitating the caulk container to be stored when said caulk container is opened, said pair of cylinders comprising:

a first cylinder having a first end, a second end and an outer wall extending therebetween, said outer wall having an inner surface and an outer surface, said second end being open, said first cylinder being substantially hollow, said first cylinder having a cone being coupled to said first end, said cone being substantially hollow, an interior of said cone being in fluid communication with an interior of said first cylinder, said caulk container being selectively positioned in said first cylinder having said spout being positioned within said cone, said outer surface being recessed adjacent to said second end to define a recessed portion of said outer surface, said recessed portion being threaded, a first gasket being coupled to said inner surface of said first cylinder at a location generally midway between said first and said second end of said first cylinder, said first gasket being continuous such that said first gasket forms a closed loop, said first gasket frictionally engaging said tube when said caulk container is positioned in said first cylinder, a second cylinder having a primary end, a secondary end an exterior wall extending therebetween, said primary end being open, said second cylinder being substantially hollow, said exterior wall having an inside surface, said primary end insertably receiving said recessed portion having said inside surface threadably engaging said recessed portion such that said second cylinder is mated to said first cylinder, and a second gasket being coupled to said inside surface of said second cylinder, said second gasket being continuous such that said second gasket forms a closed loop, said second gasket frictionally engaging said tube when said caulk container is positioned in said second cylinder.

* * * * *